US009630392B2

(12) United States Patent
Fujiwara et al.

(10) Patent No.: US 9,630,392 B2
(45) Date of Patent: Apr. 25, 2017

(54) PRINTING CYLINDER ASSEMBLY FOR A PRINTING MACHINE

(71) Applicants: Reishi Fujiwara, Daisen (JP); Hitoshi Tomaki, Daisen (JP); Kazumi Odashima, Daisen (JP)

(72) Inventors: Reishi Fujiwara, Daisen (JP); Hitoshi Tomaki, Daisen (JP); Kazumi Odashima, Daisen (JP)

(73) Assignee: MIYAKOSHI PRINTING MACHINERY CO., LTD., Narashino-Shi, Chiba (JP)

( * ) Notice: Subject to any disclaimer, the term of this patent is extended or adjusted under 35 U.S.C. 154(b) by 0 days.

(21) Appl. No.: 14/680,639

(22) Filed: Apr. 7, 2015

(65) Prior Publication Data

US 2015/0314586 A1 Nov. 5, 2015

(30) Foreign Application Priority Data

Apr. 30, 2014 (JP) ..... 2014-093525

(51) Int. Cl.
*B41F 27/10* (2006.01)
*B41F 9/18* (2006.01)
(Continued)

(52) U.S. Cl.
CPC ..... *B41F 3/54* (2013.01); *B41F 13/10* (2013.01); *B41F 13/193* (2013.01); *B41F 13/20* (2013.01);
(Continued)

(58) Field of Classification Search
CPC ..... B41F 27/105; B41F 13/20; B41F 13/21; B41F 9/18; B41F 3/20; B41F 13/44; B41F 27/1231; B41P 2227/21
See application file for complete search history.

(56) References Cited

U.S. PATENT DOCUMENTS 5,036,766 A * 8/1991 Songer ..... B41F 27/105 101/375
5,168,810 A * 12/1992 Kojima ..... B41F 27/005 101/378
(Continued)

FOREIGN PATENT DOCUMENTS

DE 10331943 A1 2/2005
EP 2311637 A1 4/2011
(Continued)

OTHER PUBLICATIONS

Extended European Search Report dated Oct. 8, 2015, issued in counterpart European Application No. 15165427.4.

*Primary Examiner* — Robert Huber
*Assistant Examiner* — John M Royston
(74) *Attorney, Agent, or Firm* — Holtz, Holtz & Volek PC

(57) ABSTRACT

A printing cylinder assembly for a printing machine includes a rotating shaft pivotally supported at one axial end shaft section thereof in a cantilever structure, and a sleeve cylinder removably mounted on the rotating shaft so that the cylinder can be fitted on and extracted from the rotating shaft from the other axial end side of the rotating shaft. The rotating shaft is formed at one axial end side thereof with a sleeve cylinder supporting tapered surface, and the sleeve cylinder is formed at one axial end side of an inner diameter portion thereof with a tapered surface, whereby the tapered surface of the sleeve cylinder can be fitted on and in close contact with the sleeve cylinder supporting tapered surface of the rotating shaft and thereby detachably coupling one axial end portion of the sleeve cylinder with one axial end portion of the rotating shaft.

7 Claims, 9 Drawing Sheets

(51) Int. Cl.

| | |
|---|---|
| ***B41F 3/20*** | (2006.01) |
| ***B41F 13/20*** | (2006.01) |
| ***B41F 13/21*** | (2006.01) |
| ***B41F 13/44*** | (2006.01) |
| ***B41F 27/12*** | (2006.01) |
| ***B41F 3/54*** | (2006.01) |
| ***B41F 30/04*** | (2006.01) |
| ***B41F 13/10*** | (2006.01) |
| ***B41F 13/193*** | (2006.01) |
| ***B41F 27/14*** | (2006.01) |

(52) U.S. Cl.

CPC ..... *B41F 27/1206* (2013.01); *B41F 27/14* (2013.01); *B41F 30/04* (2013.01); *B41F 3/20* (2013.01); *B41F 9/18* (2013.01); *B41F 13/21* (2013.01); *B41F 13/44* (2013.01); *B41F 27/105* (2013.01); *B41F 27/1231* (2013.01); *B41P 2213/802* (2013.01); *B41P 2217/15* (2013.01); *B41P 2227/21* (2013.01)

(56) References Cited

U.S. PATENT DOCUMENTS

| | | | | |
|---|---|---|---|---|
| 2005/0069353 | A1 | 3/2005 | Nagy et al. | |
| 2006/0081140 | A1* | 4/2006 | Machaj | B41F 13/08 101/212 |
| 2008/0173196 | A1* | 7/2008 | Iwamoto | B41F 27/105 101/375 |
| 2010/0024673 | A1* | 2/2010 | Schneider | B41F 27/1206 101/477 |
| 2011/0120332 | A1 | 5/2011 | Izume | |
| 2014/0053744 | A1* | 2/2014 | Guaraldi | B41F 13/02 101/217 |
| 2014/0123864 | A1 | 5/2014 | Izawa et al. | |

FOREIGN PATENT DOCUMENTS

| | | | | |
|---|---|---|---|---|
| EP | 2727729 | A1 | | 5/2014 |
| JP | 11010830 | A | * | 1/1999 |
| JP | 2004074526 | A | | 3/2004 |
| JP | 2012030413 | A | * | 2/2012 |

* cited by examiner

PRINTING CYLINDER ASSEMBLY FOR A PRINTING MACHINE

BACKGROUND OF THE INVENTION

Technical Field

The present invention relates to a printing cylinder assembly for a printing machine in which a printing cylinder whose diameter is variable is used to produce printed images that are different in their vertical length.

Background Art

A printing machine designed to print on a continuous sheet or web of paper, printed images which are different in vertical length has been disclosed in JP 2004-74526 A.

Such printing machines are known as a sleeve cylinder exchangeable variable printer, in which a printing cylinder comprises a sleeve cylinder removably mounted on the rotating shaft so that it can be fitted on, and be extracted from, the rotating shaft. A plurality of sleeve cylinders of different diameters are prepared for printing images of different vertical lengths and a sleeve cylinder is selected which is of a particular diameter that meets with a particular vertical size of an image to be printed. Each of such sleeve cylinders is mounted on the rotating shaft to print on a continuous sheet or web of paper print images different in vertical length.

To enable a sleeve cylinder to be exchanged in the conventional printing cylinder assembly described above in which the sleeve cylinder is removably mounted on the rotating shaft so that it can be fitted on and be extracted from the rotating shaft, it is necessary to couple the sleeve cylinder and the rotating shaft together so that the sleeve cylinder may not move axially or rotate around the rotating shaft but may be rotated integrally with the rotating shaft, and by releasing the coupling to decouple the sleeve cylinder from the rotating shaft so that the sleeve cylinder may be extracted from the rotating shaft and be replaced by another sleeve cylinder to be fitted on the rotating shaft.

However, making the assembly capable of fitting a sleeve cylinder on, and extracting it from, a rotating shaft in a conventional manner, tends to cause a backlash and axial deflection of the sleeve cylinder.

In view of such problems in the prior art, it is an object of the present invention to provide a printing cylinder assembly for a printing machine which ensures that a sleeve cylinder for removably mounting on a rotating shaft so that it can be fitted on and extracted therefrom be firmly coupled to the rotating shaft, without causing a possible backlash and axial deflection of the sleeve cylinder and yet permitting it to be readily decoupled.

DISCLOSURE OF THE INVENTION

The present invention provides a printing cylinder assembly for a printing machine, characterized in that it comprises: a rotating shaft pivotally supported at one axial end shaft section thereof in a cantilever structure, and a sleeve cylinder removably mounted on the rotating shaft so that the cylinder can be fitted on and extracted from the rotating shaft from the other axial end side of the rotating shaft, the rotating shaft being formed at one axial end side thereof with a sleeve cylinder supporting tapered surface, and the sleeve cylinder being formed at one axial end side of an inner diameter portion thereof with a tapered surface, whereby bring the tapered surface of the sleeve cylinder to be fitted on and in close contact with the sleeve cylinder supporting tapered surface of said rotating shaft and thereby detachably coupling one axial end portion of the sleeve cylinder with one axial end portion of the rotating shaft.

In a printing cylinder assembly provided for a printing machine in accordance with the present invention as set forth above, said rotating shaft is formed at the other axial end side thereof with a sleeve cylinder supporting outer peripheral surface, and the sleeve cylinder is formed at the other axial end side of the inner diameter portion thereof with a shaft mounting bore, the sleeve cylinder supporting peripheral surface of the rotating shaft and the shaft mounting bore of the sleeve cylinder being spaced apart from each other, defining an annular space between them, the sleeve cylinder having a shaft fastening mechanism mounted thereon for frictionally fastening the sleeve cylinder supporting outer peripheral surface of the rotating shaft and the shaft mounting bore of the sleeve cylinder.

According to the printing cylinder assembly of the invention constructed as mentioned above, by means of the shaft fastening mechanism by which the shaft mounting bore formed at the other axial end side of the sleeve cylinder can be frictionally fastened to the sleeve cylinder supporting outer peripheral surface at the other axial end side of the rotating shaft, in conjunction with the tapered surface formed on the one axial end side of the sleeve cylinder that can be coupled in close contact with the tapered surface formed on one axial end side of the rotating shaft, it should be noted that advantages are achieved of the capability of holding the sleeve cylinder on the rotating shaft coaxially with precision, increasing the reproducibility of the state that such precise holding is held for another sleeve cylinder exchanged and enhancing the accuracy of its holding.

In turn, the printing precision and quality can be thereby achieved according to the present invention.

Specifically in a printing cylinder assembly provided for a printing machine in accordance with the present invention as set forth above, the shaft fastening mechanism comprises a deformable fastening member interposed in the annular space between the cylinder supporting outer peripheral surface of the rotating shaft and the shaft mounting bore of the sleeve cylinder, and a fastening bolt for expanding and contracting the fastening member whereby fastening and unfastening the fastening bolt expand and contract the fastening member, respectively.

According to the printing cylinder assembly of the invention constructed as mentioned above, it should be noted that contracting a shaft fastening member to form an annular gap between the shaft fastening member and the sleeve cylinder supporting peripheral surface of the rotating shaft advantageously allows the sleeve cylinder to be fitted on and extracted from the rotating shaft.

Specifically, a printing cylinder assembly provided for a printing machine in accordance with the present invention as set forth above, further comprising a sleeve cylinder pushing member mounted on the rotating shaft at a side that is closer to the one axial end side than the sleeve cylinder supporting tapered surface is, for pushing the sleeve cylinder towards the other axial end shaft section According to the printing cylinder assembly of the invention constructed as mentioned above, it should be noted that axially pushing the sleeve cylinder by the sleeve cylinder pushing member advantageously releases the close contact between the sleeve cylinder supporting tapered surface of the rotating shaft and the tapered surface of the sleeve cylinder, thus facilitating extraction of the sleeve cylinder.

Specifically, in a printing cylinder assembly provided for a printing machine in accordance with the present invention as set forth above, the sleeve cylinder pushing member comprises a rotor rotatably mounted on the rotating shaft and a cam formed on the rotor, the cam having an arc-like cam surface off-centered from the center of the rotor whereby rotation of the rotor in a direction forces said cam surface to push one axial end face of the sleeve cylinder.

According to the printing cylinder assembly of the invention constructed as mentioned above, it should be noted that rotating the rotor by a rotating tool to cause the cam surface of the cam to push the sleeve cylinder advantageously releases the close contact between the sleeve cylinder supporting tapered surface of the rotating shaft and the tapered surface of the sleeve cylinder in a simple operation.

Specifically, a printing cylinder assembly provided for a printing machine in accordance with the present invention as set forth above, further comprises a positioning means mounted across the one axial end side of the sleeve cylinder and a site on the rotating shaft that is closer to the one axial end side thereof than the sleeve cylinder supporting tapered surface is, for rotationally positioning the sleeve cylinder.

According to the printing cylinder assembly of the invention constructed as mentioned above, it should be noted that the sleeve cylinders can advantageously be mounted constantly at their identical rotational position at all times, thereby permitting their respective images to be precisely printed at a given vertical position.

Specifically, in a printing cylinder assembly provided for a printing machine in accordance with the present invention as set forth above, the positioning means comprises a pin mounted at the site on said rotating shaft that is closer to the one axial end side thereof than the sleeve cylinder supporting tapered surface is and a groove formed in the one axial end face of the sleeve cylinder so as to be open to the pin, and the groove is fitted on the pin, thereby determining the rotational position of the sleeve cylinder.

According to the printing cylinder assembly of the invention constructed as mentioned above, it should be noted that moving the sleeve cylinder along the rotating shaft to be fitted thereon allows the groove advantageously to be fitted on the pin, permitting the sleeve cylinder to be rotationally positioned in a simple manner.

Specifically, in a printing cylinder assembly provided for a printing machine in accordance with the present invention as set forth above, the rotating shaft is pivotally supported at the one axial end shaft section thereof in the cantilever structure so that it may not develop an axial deflection or thrust load, and the sleeve cylinder has a hollow structure, is formed axially with a plurality of annular disk shaped ribs on its inner periphery side and made by casting of an aluminum alloy, the plural ribs forming an inner diameter portion for fitting on said rotating shaft, whereby the sleeve cylinder can be brought to be fitted on, and be extracted from the rotating shaft from the other axial end portion of the rotating shaft.

According to the printing cylinder assembly of the invention constructed as mentioned above, it should be noted that the weight of the sleeve cylinder can advantageously be reduced, permitting a sleeve cylinder to be brought from the other axial end shaft section manually to be fitted on and extracted from the rotating shaft in a simple way, thereby facilitating a manual operation for exchanging of the sleeve cylinders.

Specifically, in a printing cylinder assembly provided for a printing machine in accordance with the present invention as set forth above, the sleeve cylinder is composed of an aluminum alloy, comprising a cylinder body formed axially with a plurality of annular disk shaped ribs on an inner peripheral surface of the cylinder body, the plural ribs forming an inner diameter portion for fitting on the rotating shaft, the cylinder body having on the inner peripheral surface thereof a first convex area for groove machining and a dynamically balancing, a second convex area positioned diametrically symmetrical to the first convex area, the cylinder body being machined at a region of the first convex area to form a groove therein for insertion of a grip leading and a grip trailing end of an insertion type printing plate, the sleeve cylinder thereby constituting a plate cylinder.

According to the printing cylinder assembly of the invention constructed as mentioned above, it should be noted that the plate insertion groove can be made greater in depth than in the thickness of the cylinder body of the sleeve cylinder (the thickness of the sleeve cylinder) so as to firmly receive and support the grip leading and training ends of an insertion type printing plate.

Moreover, it is made possible to keep rotational balance of the sleeve cylinder and to increase its rate of rotation and hence to print at higher speed.

According to the present invention, it should be noted that constituting a printing cylinder by a sleeve cylinder being able to be fitted on and extracted from a rotating shaft allows the sleeve cylinder advantageously to be coupled and fastened to the rotating shaft, without causing a backlash and axial deflection of the sleeve cylinder mounted and yet permitting it to be readily decoupled and unfastened.

BEST MODES FOR CARRYING OUT THE INVENTION

Figure 1:
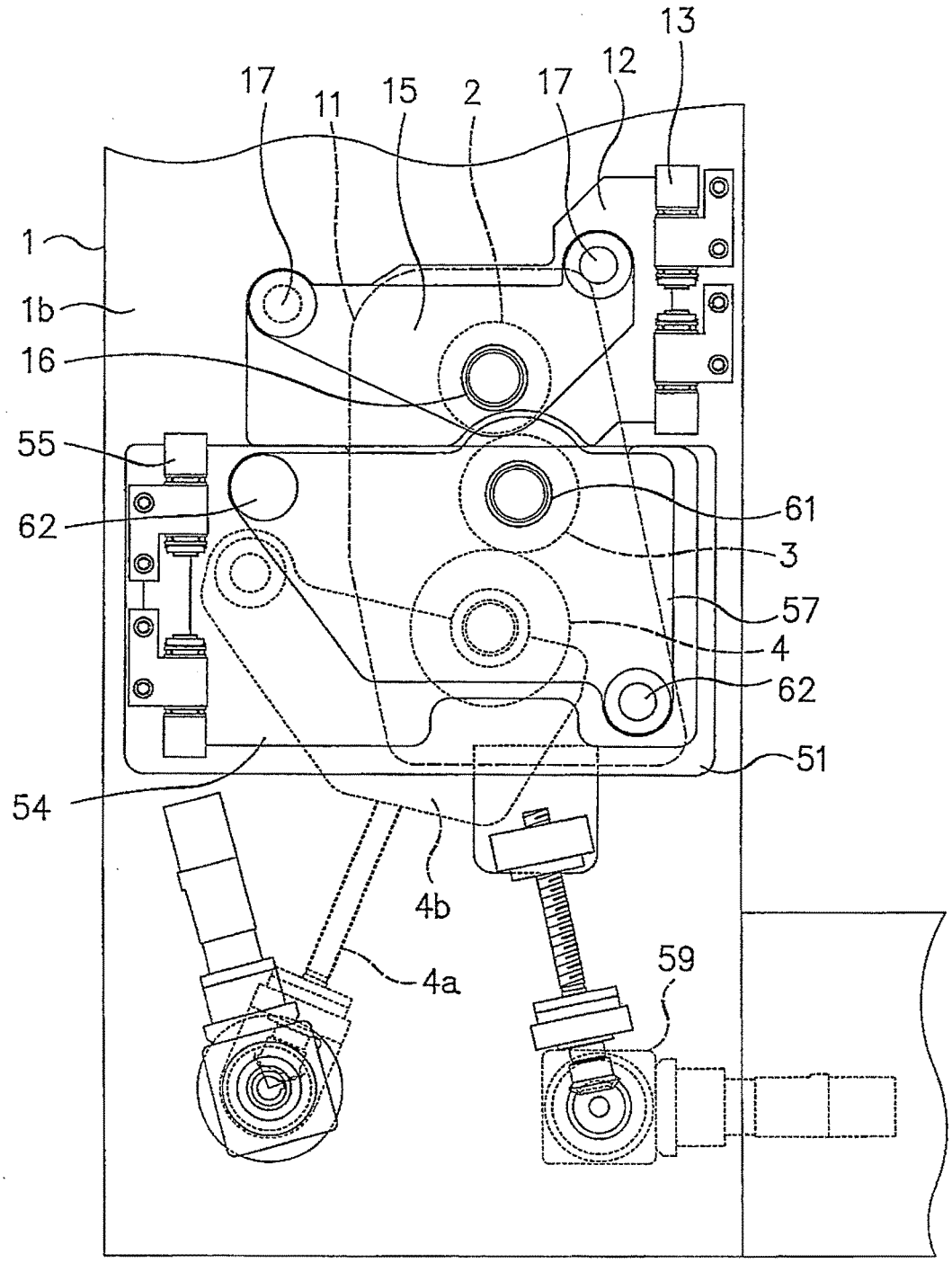
FIG. 1 is a front view of a printing machine.

The printing machine as shown in FIG. 1 includes a main frame 1 having a plate cylinder 2, a blanket cylinder 3 and an impression cylinder 4 which are rotatably mounted on the main frame 1. The plate cylinder 2 and the blanket cylinder 3 each constitutes a printing cylinder in a printing cylinder assembly of the invention.

Figure 2:
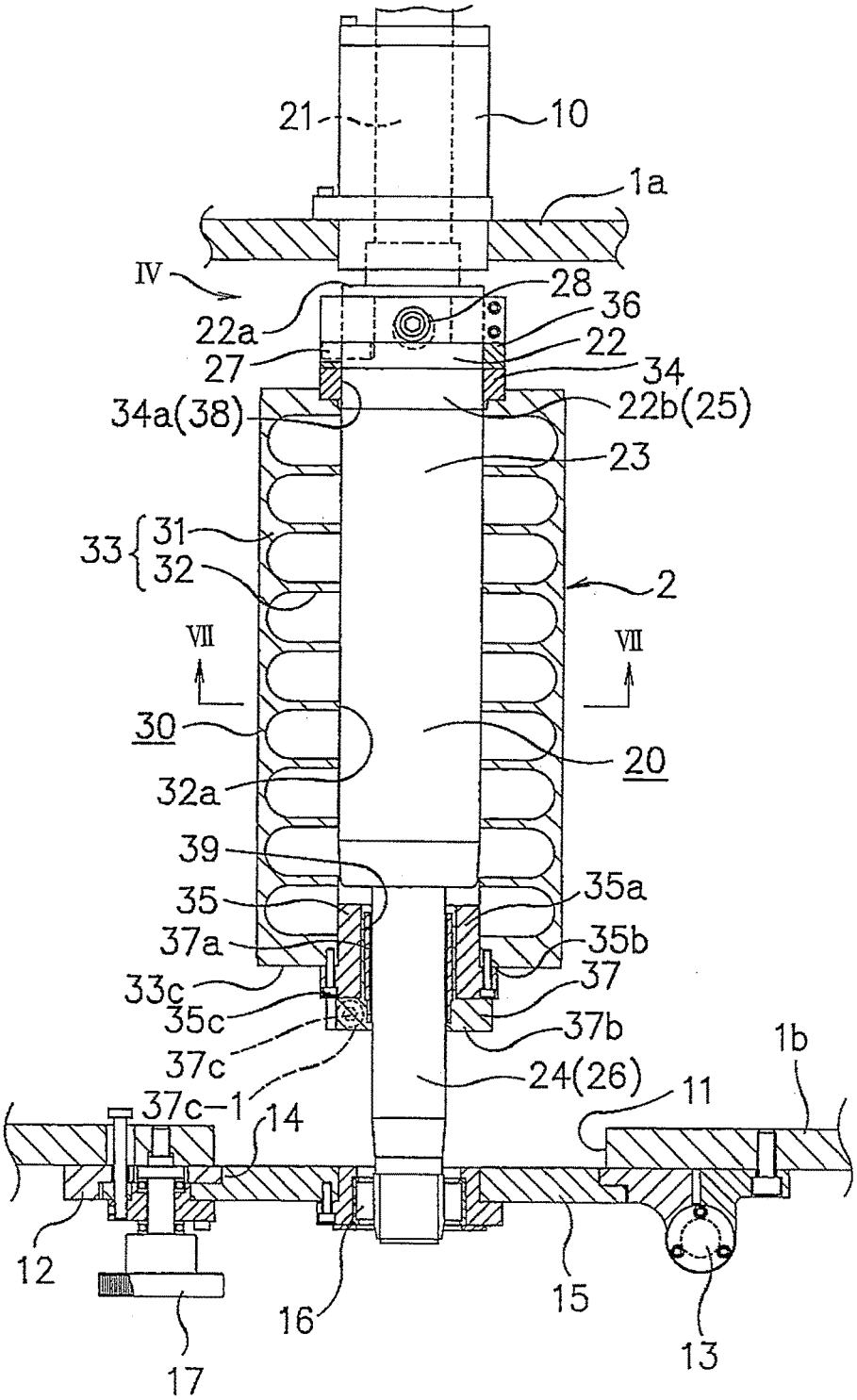
FIG. 2 is a transverse sectional view of and illustrating a cylinder assembly of the invention shown in FIG. 1 and in which the printing cylinder is a plate cylinder.
Figure 3:
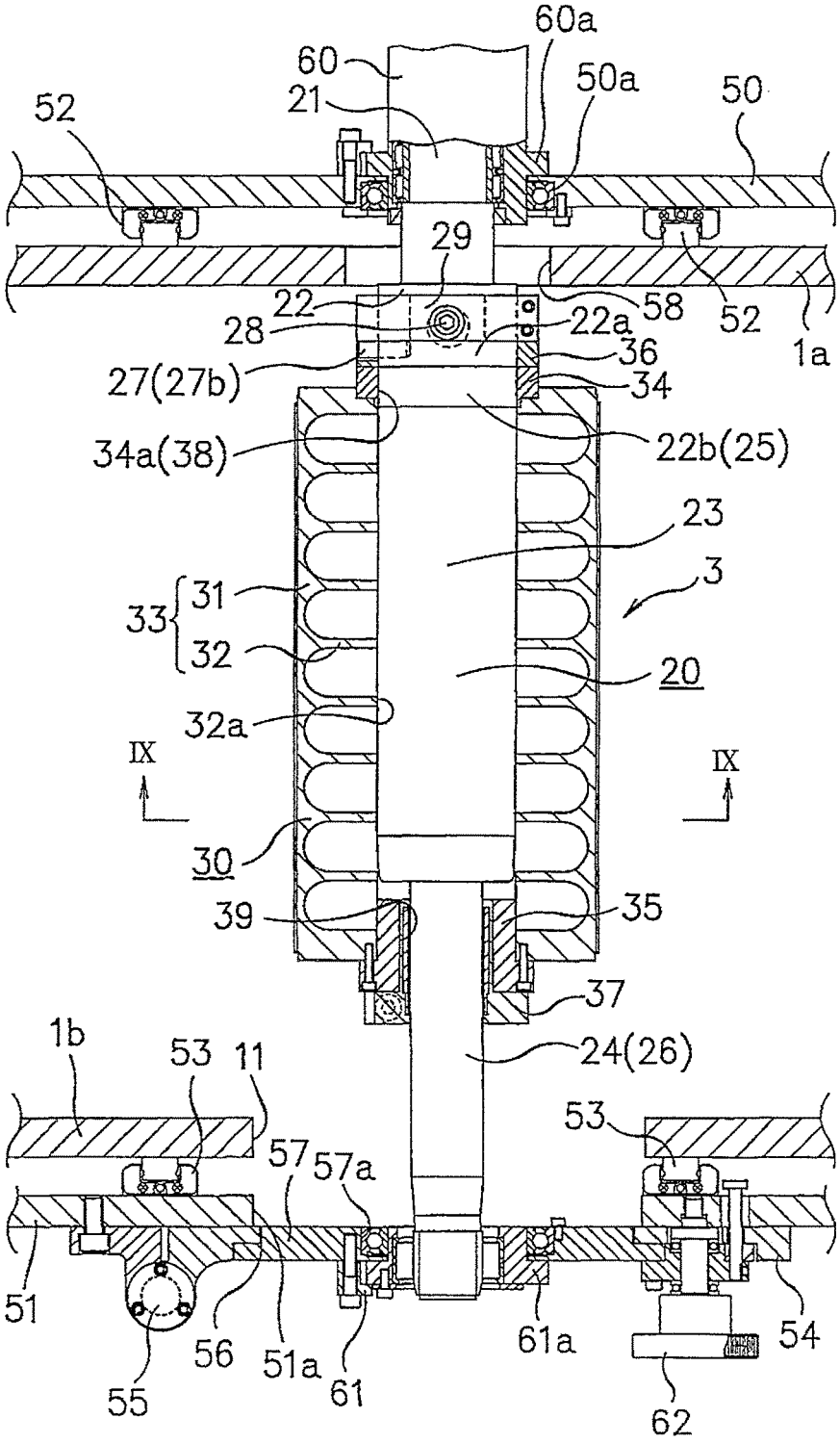
FIG. 3 is a transverse sectional view of and illustrating a cylinder assembly of the invention shown in FIG. 1 and in which the printing cylinder is a blanket cylinder.

As shown in FIGS. 1, 2 and 3, the main frame 1 has one side main frame member 1*a* and the other side frame member 1*b* at one and the other sides in the axial direction of the cylinders.

As shown in FIG. 2, in the printing cylinder assembly the plate cylinder 2 is constituted by a rotating shaft 20 and a sleeve cylinder 30 removably mounted on the rotating shaft 20 so that the sleeve cylinder 30 can be fitted on and extracted from the rotating shaft 20.

As shown in FIG. 3, the blanket cylinder 3 as with the plate cylinder 2 is constituted by a rotating shaft 20 and a sleeve cylinder 30 removably mounted on the rotating shaft 20 so that the sleeve cylinder 30 can be fitted on and extracted from the rotating shaft 20.

The rotating shaft 20 for the plate cylinder 2 and the rotating shaft 20 for the blanket cylinder 3 are shaped alike. The rotating shaft 20 for the plate cylinder 2 is as shown in FIG. 2 mounted on the one side and the other side main frame members 1*a* and 1*b*, and the rotating shaft 20 for the blanket cylinder 3 is as shown in FIG. 3 mounted on one side and the other side auxiliary frame members 50 and 51 disposed outsides of the one side and the other side main frame members 1*a* and 1*b*, respectively. Hence, the rotating shaft 20 for the blanket cylinder 3 is made longer than the rotating shaft 20 for the plate cylinder 2.

The sleeve cylinder 30 of the plate cylinder 2 and the sleeve cylinder 30 of the blanket cylinder 3 are alike in shape and identical in length.

Explanation is now given of a structure for mounting the rotating shaft 20 for the plate cylinder 2 with reference to FIG. 2.

One axial end portion of the rotating shaft 20 is pivotally supported by one end bearing member 10 mounted on the one side main frame member 1*a* rotatably and in a cantilever structure to allow the sleeve cylinder 30 to be exchanged from outside of the other side main frame member 1*b* for another sleeve cylinder 30 different in diameter to alter the diameter of the plate cylinder 2.

The other side main frame member 1*b* has an opening 11 for inserting and extracting the plate/blanket cylinder 2/3 and is provided with a turning frame for plate cylinder 12 mounted thereon with a hinge 13 so as to be turnable.

The turning frame for plate cylinder 12 is adapted to turn between a first position at which it is in contact with an outer side surface of the other side main frame member 1*b* and faces the other axial end portion of the plate cylinder 2 and a second position at which it is separated from the outer side surface of the other side main frame member 1*b* and from the other axial end portion of the plate cylinder 2 to permit the sleeve cylinder 30 to be extracted through the opening 11.

The turning frame for plate cylinder 12 has a hole 14 through which a portion of the rotating shaft 20 that is closer to its other axial end can pass and in which a plate cylinder housing member 15 is mounted so as to be fitted therein.

By means of the other end bearing member 16 with which the plate cylinder housing member 15 is provided, the other axial end portion of the rotating shaft 20 is supported rotatably so as to be capable of being axially inserted into and extracted from the member 16.

And, operating move units 17 moves the plate cylinder housing member 15 towards and away from the turning frame for plate cylinder 12. When the turning frame for plate cylinder 12 lies at the first position, the plate cylinder housing member 15 is moved axially of the plate cylinder 2 between a position at which the other end bearing member 16 takes a support position to support the other axial end portion of the rotating shaft 20 and a position at which the member 16 takes a release position to release the support, while the housing member 15 maintaining its position parallel to the turning frame for plate cylinder 12.

The move units 17 as shown in FIG. 1 are positioned at right and left sides of the plate cylinder housing member 15. The rotating shaft 20 for the plate cylinder 2 is supported at an intermediate support position between the right and left sides of the plate cylinder housing member 15. Operating the right and left move units 17 translates the plate cylinder housing member 15 axially of the rotating shaft 20.

This allows the other end bearing member 16 to be extracted from the other axial end portion of the rotating shaft 20 by moving the plate cylinder housing member 15, and the turning frame for plate cylinder 12 to turn, thus to open the opening 11.

And, the rotating shaft 20 is pivotally supported in a cantilever structure from the one side main frame member 1*a* in the structure that an axial deflection or thrust load may not develop, and it is made possible for a sleeve cylinder 30 to fitted in, and to be extracted from, the rotating shaft 20 through the opening 11 of the other side main frame member 1*b*.

Thus, one sleeve cylinder 30 for the plate cylinder 2 can be exchanged for another sleeve cylinder 30 of a different diameter.

Mention is made next of a structure for mounting a rotating shaft 20 for the blanket cylinder 3.

As shown in FIG. 3, the one side and other side main frame members 1*a* and 1*b* are provided outside thereof with one side and the other side auxiliary frame member 50 and 51, respectively, each of which is movable towards and away from the plate cylinder 2.

For example, on the outer side surface of the one side main frame member 1*a* there is provided a pair of right and left one side linear guides 52 and 52 which make the one side auxiliary frame member 50 movable towards and away from the plate cylinder 2.

On the outer side surface of the other side main frame member 1*b* there is provided a pair of right and left hand other side linear guides 53 and 53 which make the other side auxiliary frame 51 movable towards and away from the plate cylinder 2.

The other side auxiliary frame 51 has a turning frame for blanket cylinder 54 mounted thereto as so as to be capable of turning with a hinge 55.

The turning frame for blanket cylinder 54 is adapted to turn between a first position at which it closes an opening 51*a* of the other side auxiliary frame member 51 and faces the other axial end portion of the blanket cylinder 3 and a second position at which it opens the opening 51*a* to allow the sleeve cylinder 30 to be extracted through the opening 51*a*. The opening 51*a* is opposite to the opening 11 of the other side main frame member 1*b* to allow the blanket cylinder 3 to pass through them.

The turning frame for blanket cylinder 54 has a hole 56 into which a blanket cylinder housing member 57 is fitted.

The one axial end portion of the rotating shaft 20 passes through a hole 58 in the one side main frame member 1*a* and is pivotally supported rotatably and in a cantilever structure by one end bearing member 60 with which the one side auxiliary frame member 50 is provided.

The other axial end portion of the rotating shaft 20 projects axially outwards from the opening 11 of the other side main frame member 1*b* and the opening 51*a* of the other side auxiliary frame member 51. By means of the other end bearing member 61 with which the blanket cylinder housing member 57 is provided, the other axial end portion of the rotating shaft 20 is supported rotatably so as to be capable of being axially inserted into and extracted from the member 61.

And, by operating move units 62, the blanket cylinder housing member 57 as with the plate cylinder housing member 15 is moved towards and away from the turning frame for blanket cylinder 54. When the turning frame for blanket cylinder 54 lies at the first position, the blanket cylinder housing member 57 is translated axially of the blanket cylinder 3 between a position at which the other end bearing member 61 takes a support position to support the other axial end portion of the rotating shaft 20 and a position at which it takes a release position to release the support.

The other end bearing member 61 when at the support position is fitted on the other axial end portion of the rotating shaft 20 to support it rotatably and when at the release position to release the support is extracted from the other axial end portion to release the support for it.

This allows the other end bearing member 61 to be extracted from the other axial end portion of the rotating shaft 20 by moving the blanket cylinder housing member 57, and the turning frame for blanket cylinder 54 to turn to the second position, thus to open the opening 51*a*.

And, the rotating shaft 20 is pivotally supported in a cantilever structure from the one side auxiliary frame member 50 in the structure that an axial deflection or thrust load may not develop, and it is made possible for a sleeve cylinder 30 to be fitted on, and to be extracted from, the rotating shaft 20 through the opening 11 of the other side main frame member 1*b*.

Thus, one sleeve cylinder 30 for the blanket cylinder 3 can be exchanged for another sleeve cylinder 30 of a different diameter.

As can be seen from FIG. 1, the main frame 1 is provided with a move mechanism 59 for displacing the one and other side auxiliary frame members 50 and 51. Driving the move mechanism 59 moves the one side and other side auxiliary frame members 50 and 51. As the blanket cylinder 3 is moved towards and away from the plate cylinder 2, the distance between the center of the plate cylinder 2 and the center of the blanket cylinder 3 is varied.

Thus, in printing print images different in vertical length as mentioned above by exchanging a sleeve cylinder 30 for the plate cylinder 2 and a sleeve cylinder 30 for the blanket cylinder 3 for sleeve cylinders different in diameter to change the peripheral lengths of the plate and blanket cylinders 2 and 3, the distance between the center of the plate cylinder 2 and the center of the blanket cylinder 3 is varied in response to variation of the diameters of the plate and blanket cylinders 2 and 3 so as to ensure that the plate and blanket cylinders 2 and 3 are made in contact properly with each other.

The one end and other end bearing members 60 and 61 for rotatably supporting both the one and other axial end portions of the rotating shaft for the blanket cylinder 3 on the one side and other side auxiliary frame members 50 and 51 are each of an eccentric bearing such that they can move the blanket cylinder 3 away from the plate and impression cylinders 2 and 4.

For example, a bearing box 61*a* of the other end bearing member 61 has an inner peripheral surface eccentric to its outer peripheral surface and is mounted rotatably in a hole 57*a* of the blanket cylinder housing member 57. Then, rotating the bearing box 61*a* by a rotating means (not shown) eccentrically rotates the rotating shaft 20, thereby moving the blanket cylinder 3 towards and away from the plate and impression cylinders 2 and 4.

Likewise, a bearing box 60*a* in the one end bearing member 60 is rotatably supported in a hole 50*a* of the one side auxiliary frame member 50.

The rotating means for the bearing boxes 60*a* and 61*a* may be of, though not limited to, a structure having arms fastened to the bearing boxes 60*a* and 61*a* and a link connected to the arms and swung by a cylinder or an electric motor whereby swinging the link causes the bearing boxes 60*a* and 61*a* to rotate.

Moving the blanket cylinder 3 away from the plate and impression cylinders 2 and 4 as mentioned above facilitates the operation of exchanging the plate of the plate cylinder 2 and also the operation of paper passing.

The impression cylinder 4 as shown in FIG. 1 is rotatably attached to an arm 4*b* swung by a swinging mechanism 4*a*.

Mention is next made of details of the plate cylinder 2 with reference to FIGS. 2, 4, 5 and 6.

The rotating shaft 20 for the plate cylinder 2 comprises the one axial end shaft section 21, one axial end side shaft section 22, axial intermediate shaft section 23 and the other axial end shaft section 24.

The one axial end shaft section 21 and the other axial end shaft section 24 are smaller in diameter than the one axial end side shaft section 22 and the axial intermediate shaft section 23 as shown. The one axial end shaft section 21 is supported by the one side bearing member 10 on the one side main frame 1*a* and the other axial end shaft section 24 is supported by the other side bearing member 16 on the plate cylinder housing member 15.

The one axial end side shaft section 22 comprises a large diameter portion 22*a* closer to the one axial end and a tapered portion 22*b* closer to the other axial end. The large diameter portion 22*a* is continuous with the one axial end shaft section 21. The tapered portion 22*b* is continuous with the axial intermediate shaft section 23. The tapered portion 22*b* is designed to increase its diameter gradually towards its one axial end portion from its other axial end portion.

The rotating shaft 20 for the plate cylinder 2 thus has a sleeve cylinder supporting tapered surface 25 at one axial end side of the axial intermediate shaft section 23, i.e. at one axial end side of the rotating shaft 20 (the deep side in the sleeve cylinder fitting direction), which is opposite to its other axial end side where the sleeve cylinder 30 begins to be fitted on the rotating shaft 20, the tapered surface 25 being supporting the sleeve cylinder 30.

The other axial end portion of the sleeve cylinder 30 is to be supported on the other axial end shaft section 24 of the rotating shaft 20.

Thus, the rotating shaft 20 has a sleeve cylinder supporting outer peripheral surface 26 at the other axial end side thereof (the near side in the sleeve cylinder fitting direction) where it begins to be fitted with the sleeve cylinder 30, the outer peripheral surface 26 supporting the sleeve cylinder 30.

At sites that are closer to the one axial end than the tapered portion 22*b* (sleeve cylinder supporting tapered surface 25 of the rotating shaft 20) of the one axial end side shaft section 22 of the rotating shaft 20 is, i.e. on the large diameter portion 22*a* of the rotating shaft 20, there are shown provided respectively a positioning member 27 for rotationally positioning the sleeve cylinder 30 fitted on the rotating shaft 20 and a sleeve cylinder pushing member 28 for pushing the sleeve cylinder 30 towards the other axial end side, i.e. the near side in the sleeve cylinder fitting direction.

Figure 4:
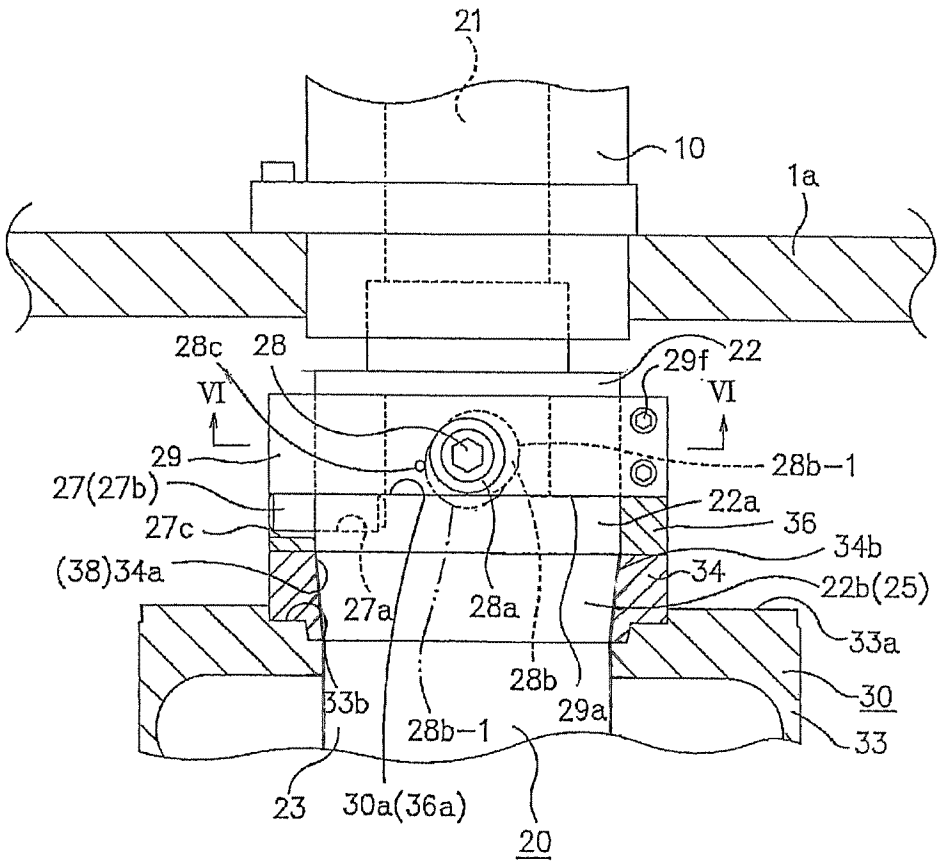
FIG. 4 is an enlarged sectional view of the part IV indicated in FIG. 2.
Figure 5:
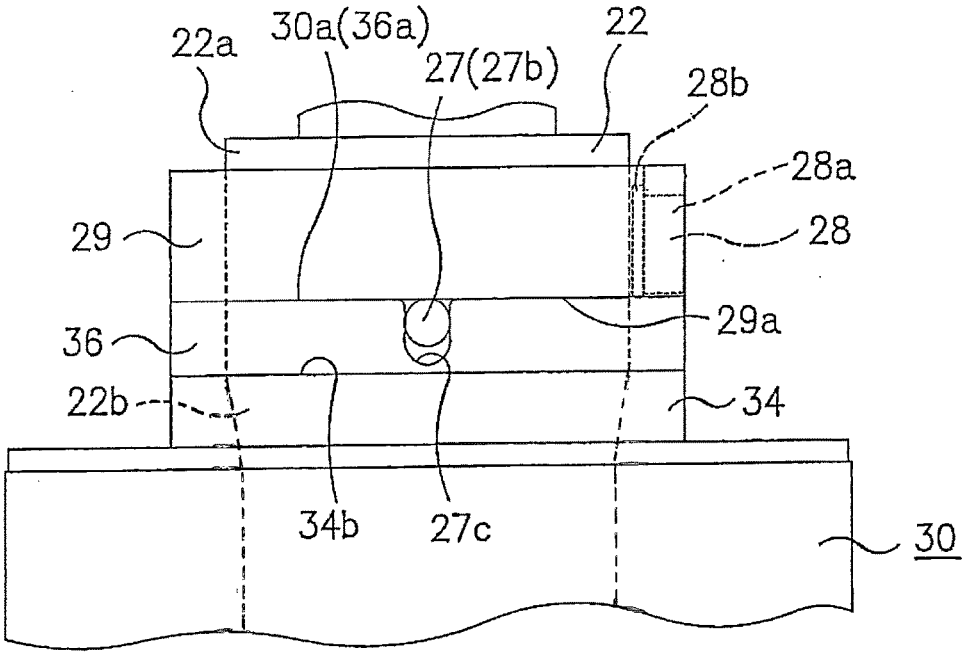
FIG. 5 is a left side view of the part IV indicated in FIG. 4.

As shown in FIGS. 4 and 5, a pusher mounting ring 29 for mounting the sleeve cylinder pushing member 28 is fitted on and fastened to the large diameter portion 22*a* of the one axial end side shaft section 22 of the rotating shaft 20 at a side closer to the one axial end. The pusher mounting ring 29 has its other axial end face 29*a* for contact with one axial end face 30*a* of the sleeve cylinder 30 fitted on the rotating shaft 20.

In the other axial end side portion of the large diameter portion 22*a* there is formed a hole 27*a* diametrically thereof, into which a pin 27*b* is inserted and fitted. The hole 27*a* and the pin 27*b* that is let to protrude from the peripheral surface of the large diameter portion 22*a* constitute the positioning member 27.

The one axial end portion of the sleeve cylinder 30 has a part to be positioned. In this form of implementation, the one axial end face 30*a* of the sleeve cylinder 30 is formed with a groove 27*c* as the part to be positioned. The groove 27*c* is open to face the pin 27*b* which, when the sleeve cylinder 30 is fitted on the rotating shaft 20, is fitted into the groove 27*c*, thereby determining the rotational position of the sleeve cylinder 30.

To wit, the positioning member (pin 27*b*) and the part to be positioned (groove 27*c*) make up a positioning means 27 for positioning a rotational position of the sleeve cylinder 30.

To wit, when the sleeve cylinder 30 is fitted on the rotating shaft 20, the one axial end face 30*a* of the sleeve cylinder 30 is brought into contact with the pin 27*b* and the pin 27*b* is fitted into the groove 27 as the sleeve cylinder 30 is rotated.

Figure 6:
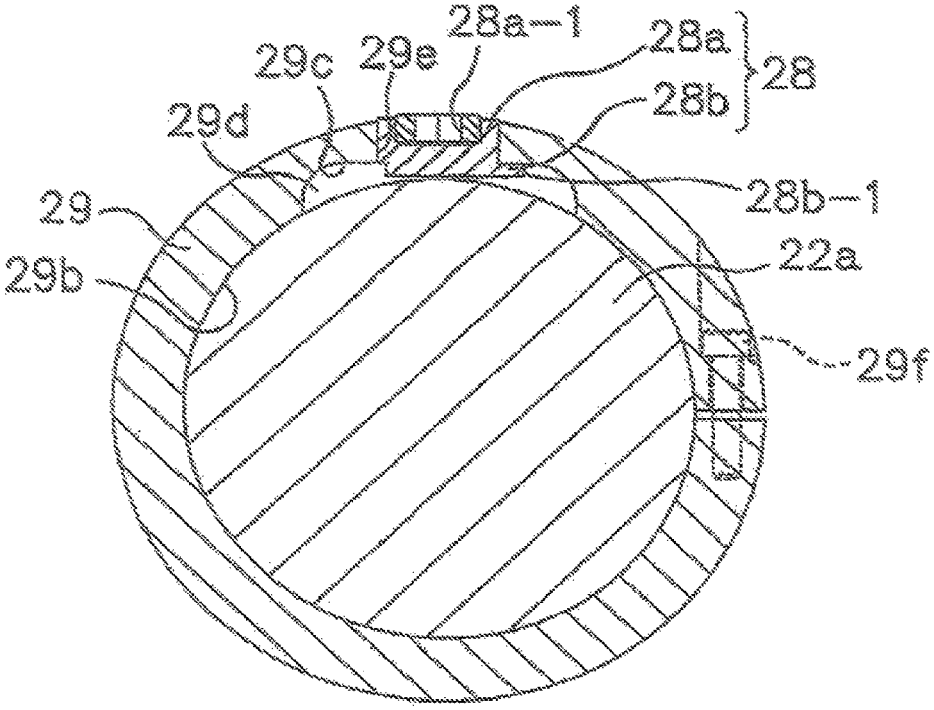
FIG. 6 is a cross sectional view of a part taken along the line VI-VI in FIG. 4.

The sleeve cylinder pushing member 28 as shown in FIGS. 4 to 6 comprises a rotor 28*a* to be rotated by a rotating tool and a cam 28*b* formed on the rotor 28*a* and being in contact with the sleeve cylinder 30 so that rotation of the rotor 28*a* causes the cam 28*b* to push the sleeve cylinder 30 towards its other axial end.

The pusher mounting ring 29 has a discontinuous ring shape and has its separated ends fastened together by screws 29*f* to make it continuous, fastening it firmly around and onto the peripheral surface of the large diameter portion 22*a*.

The pusher mounting ring 29 has its inner peripheral surface 29*b* formed with a recess 29*c* and a hollow 29*d* formed between the recess 29*c* and the large diameter portion 22*a*.

The pusher mounting ring 29 has a bore 29*e* open to the hollow 29*d*. The bore 29*e* has the rotor 28*a* rotatably mounted and fitted therein. The rotor 28*a* has a hexagon socket 28*a*-1 open to its surface. The rotor 28*a* has its rear surface having the cam 28*b* formed thereto.

The cam 28*b* has an arc-like cam surface 28*b*-1 off-centered from the Center of the rotor 28*a*. And, the cam 28*b* is rotatable together with the rotor 28*a* in the hollow 29*d*. In this form of implementation, a plug having the hexagon socket 28*a*-1 is mounted and fitted on the rotor 28*a*.

A hexagonal wrench is fitted in the hexagon socket 28*a*-1 of the rotor 28*a*. By rotating the rotor 28*a* with the hexagon wrench, as shown in FIG. 4, the cam 28*b* is received in the hollow 29*d* as indicated by the dotted line so that the cam surface 28*b*-1 is positioned closer to the one axial end of the rotating shaft 20 than the other axial end face 29*a* of the pusher mounting ring 29 is. The cam 28*b* is moved away from the one axial end face 30*a* of the sleeve cylinder 30.

By rotating the rotor 28*a* with the hexagonal wrench in the direction opposite to that as mentioned above, the cam 28*b* is allowed to project from the hollow 29*b* as indicated by the phantom line in FIG. 4. The cam surface 28*b*-1 then projects beyond the other axial end face 29*a* of the pusher mounting ring 9 towards the other axial end side of the rotating shaft 20, thereby pushing the one axial end face 30*a* of the sleeve cylinder 30. Note that the rotation of the cam 28*b* is regulated by a pin 28*c*.

The sleeve cylinder 30 is thereby pushed and moved by the cam 28*c* backwards towards the other axial end side of the rotating shaft 20, i.e. the near side in the sleeve cylinder fitting direction.

The sleeve cylinder 30 as shown in FIG. 2 has a cylinder body 31 and a plurality of ribs 32 formed, axially spaced apart from each other on an inner peripheral surface of the cylinder body 31, each of the ribs 32 being in the form of a disk having a central circular opening 32*a*. The cylinder body 31 and the ribs 32 with the circular opening 32*a* fitted on an outer peripheral surface of the rotating shaft 20 constitute a sleeve cylinder body 33. The cylinder body 33 is provided with a one side cylinder bearer 34 attached at its one axial end, the other side cylinder bearer 35 attached at its other axial end, a ring 36 attached to the one side cylinder bearer 34, and a shaft fastening mechanism 37 attached to the other side cylinder bearer 35.

As shown in FIG. 4, the one side cylinder bearer 34 of the sleeve cylinder 30 is fitted in a depressed area 33*b* of a one axial end face 33*a* of the cylinder body 33 and fastened thereto by a screw or screws (not shown).

The one side cylinder bearer 34 of the sleeve cylinder 30 has an inner peripheral surface 34*a* that is a tapered surface 38 fitted on and in close contact with the tapered portion 22*b* of the one axial end side shaft section 22 of the rotating shaft 20.

The sleeve cylinder 30 fitted on the rotating shaft 20 is thereby formed in its inner diameter portion at a side that is closer to the one axial end, i.e. the deep side in the sleeve cylinder fitting direction, with a tapered surface 38 that is fitted on and in close contact with the sleeve cylinder supporting tapered surface 25 of the rotating shaft 20.

As shown in FIGS. 4 and 5, the ring 36 is mounted on the one axial end face 34*b* of the one side cylinder bearer 34 and fastened thereto by a screw or screws (not shown). The ring 36 has one axial end face 36*a* that is formed with the groove 27*c* into which the pin 27*b* is fitted, the one axial end face 36*a* being in contact with the other axial end face 29*a* of the pusher mounting ring 29.

To wit, the one axial end face 36*a* of the ring 36 constitutes the one axial end face 30*a* of the sleeve cylinder 30.

The cylinder body 33 of the sleeve cylinder 30 has its other axial end portion which as shown in FIG. 2 is positioned closer to the other axial end of the rotating shaft 20 than the other axial end of its axial intermediate shaft section 23 is. The other axial end portion of the sleeve cylinder 30 is fitted on a cylindrical part 35*a* of the other side cylinder bearer 35. The other side cylinder bearer 35 has a flange 35*b* fastened to the other axial end face 33*c* of the cylinder body 33 by screws 35*c*. The cylindrical part 35*a* of the other side cylinder bearer 35 has an inner peripheral surface which forms a shaft mounting bore 39 that is positioned at the other axial end side of the inner diameter portion of the sleeve cylinder 30 which is fitted on the rotating shaft 20, i.e. the near side in the sleeve cylinder fitting direction.

The inner peripheral surface of the cylindrical part 35*a* of the other side cylinder bearer 35 and the outer peripheral surface of the other axial end shaft section 24 are spaced apart from each other. An annular gap is formed between these inner and outer peripheral surfaces.

The sleeve cylinder 30 is thereby provided with such an annular gap between the sleeve supporting peripheral surface 26 of the rotating shaft 20 and the shaft mounting bore 39 that is positioned at the other axial end side, i.e. the near side in the sleeve cylinder fitting direction, of the inner diameter portion of the sleeve cylinder 30 which is fitted on the rotating shaft 20.

The shaft fastening mechanism 37 as shown in FIG. 2 comprises a fastening member 37*a* and a flange 37*b* provided with a fastening bolt 37*c*. The fastening member 37*a* is interposed in the annular space between the inner peripheral surface of the cylindrical part 35*a* of the other side cylinder bearer 35 and the peripheral surface of the other axial end shaft section 24 of the rotating shaft 20 and can be expanded and contracted, i.e. is formed of a material or component that is elastically deformable. The fastening member 37 may be a fastening bush. The flange 37*b* is fixed to the other side cylinder bearer 35, e.g. by screws (not shown).

In the shaft fastening mechanism 37, the fastening member 37*a* is expanded by fastening the fastening bolt 37*c* and contracted by unfastening the fastening bolt 37*c*. For example, the fastening member 37 may comprise a deformable chamber filled with a pressure medium. The fastening bolt 37*c* is fastened to compress the pressure medium, expanding the fastening member 37*a*, and the fastening bolt 37*c* is unfastened to decompress the pressure medium, contracting the fastening member 37*a*, hence they constitute a hydraulic (oil pressure) locking system.

The cylindrical part 35*a* of the other side cylinder bearer 35 and the other axial end shaft section 24 of the rotating shaft 20 can thus be frictionally fastened together, with the fastening member 37*a* by fastening the fastening bolt 37*c*.

By unfastening the fastening bolt 37*c*, the fastening member 37*a* is contracted to separate from the outer peripheral surface of the other axial end shaft section 24 of the rotating shaft 20, thus releasing fastening of the cylindrical part 35*a* of the other side cylinder bearer 35 and the other axial end shaft section 24 of the rotating shaft 20.

The fastening bolt 37*c* in the shaft fastening mechanism 37 is formed with a hexagon socket 37*c*-1 adapted to be fitted with the hexagonal wrench.

The hexagon socket 37*c*-1 of the fastening bolt 37*c* is identical in size to the hexagon socket 28*a*-1 which is formed to the rotor 28*a* of the sleeve cylinder pushing member 28.

The ability thus gained to manipulate rotating the rotor 28*a* of the sleeve cylinder pushing member 28 and the fastening bolt 37*c* of the shaft fastening mechanism 37 with a common hexagonal wrench makes it easier to perform operations whereby a sleeve cylinder 30 is mounted on and dismounted from the rotating shaft 20.

The cylinder body 33 is formed by casting of an aluminum alloy and has its outer periphery composed of the outer peripheral surface of the cylinder body 31 and its inner periphery composed of the circular opening 32*a* of the ribs 32, the peripheries being mechanically finished.

In other words, the sleeve cylinder body 33 has a hollow structure and is provided axially with a number of the annular disk-shaped ribs 32 formed on its inner periphery side and each having an inner diameter portion to be fitted on the rotating shaft 20. The sleeve cylinder body 33 is formed by casting of an aluminum alloy and has its outer and inner peripheries mechanically finished.

The sleeve cylinder 30 which as mentioned above is mostly hollow, of a configuration having a plurality of the ribs 32 on its inner periphery and made of aluminum alloy can reduce the weight of the sleeve cylinder of the plate cylinder 2 and hence facilitates manual operation of mounting and dismounting the sleeve cylinder 30 by causing it to be fitted on, and to be extracted from, the rotating shaft 20 and expedites operation of its exchange.

Note that the sleeve cylinder 30 may be constituted of the cylinder body 33 without using the one side and other side cylinder bearers 34 and 35 made of steel. In this case, the cylinder body 33 may be formed with the tapered surface 38 in its one axial end portion (the deep side) and with the shaft mounting bore 39 in its other axial end portion (the near side).

Figure 7:
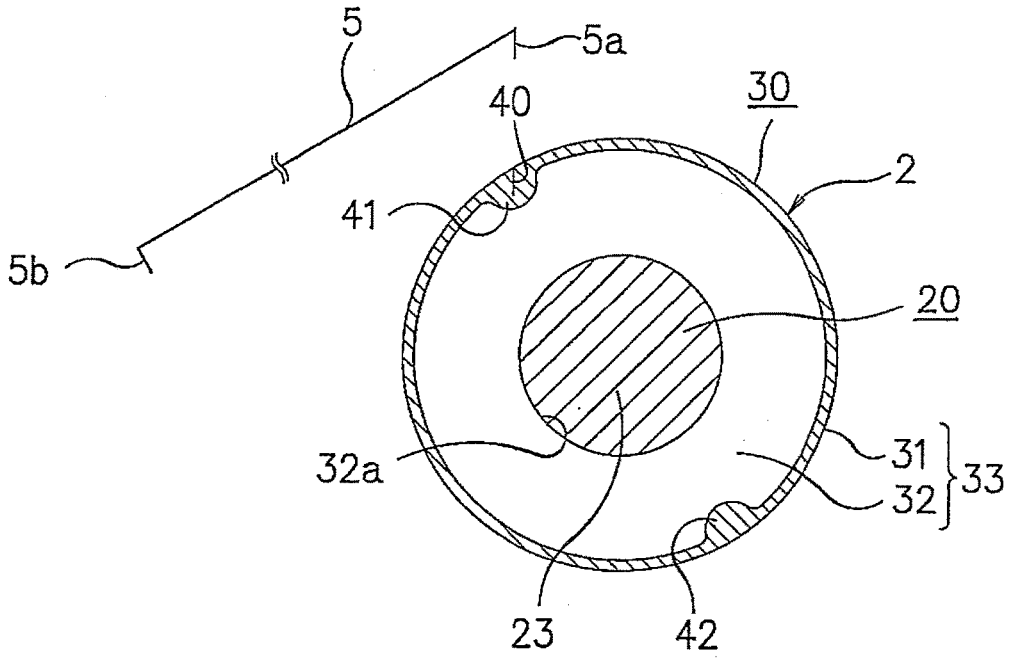
FIG. 7 is a cross sectional view of a part taken along the line VII-VII in FIG. 4.

As shown in FIG. 7, the sleeve cylinder 30 (cylinder body 33) for the plate cylinder 2 is formed on its outer peripheral surface with a plate insertion groove 40 which extends axially and into which a grip leading end 5*a* and a grip trailing end 5*b* of an insertion type printing plate 5 may be inserted.

Figure 8A:
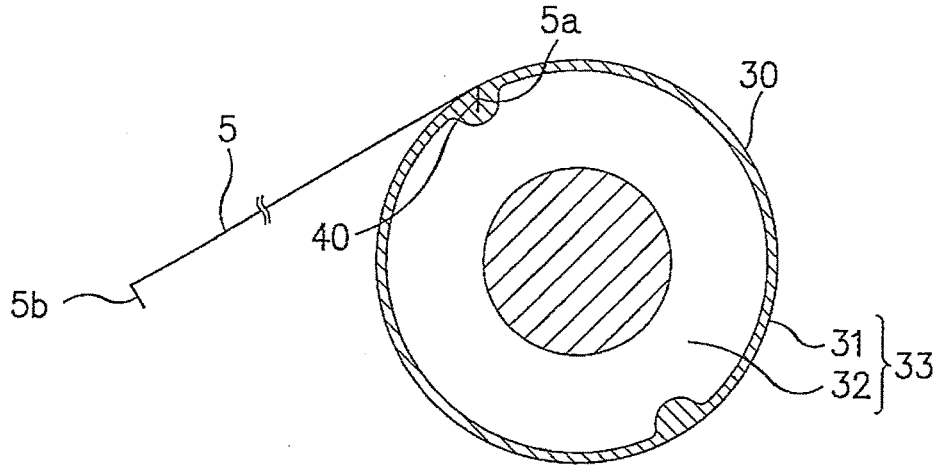
FIGS. 8A, 8B and 8C are cross sectional views for illustrating an operation of mounting an insertion type printing plate.
Figure 8B:
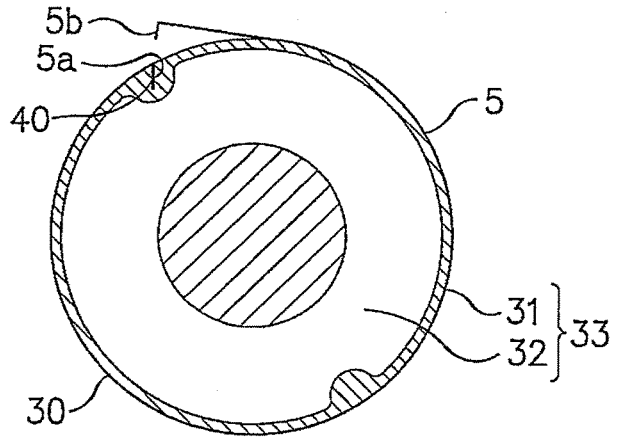
Figure 8C:
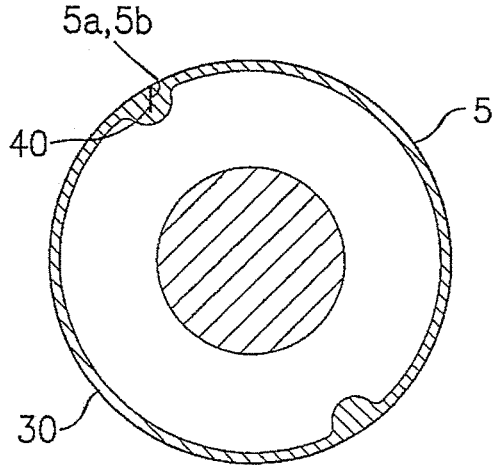

And, the grip leading end 5*a* of the insertion type printing plate 5 is inserted into the plate insertion groove 40 as shown in FIG. 8A so that the printing plate 5 is wound onto the outer peripheral surface of the sleeve cylinder 30 as shown in FIG. 8B. And, as shown in FIG. 8C the grip trailing end 5*b* of the insertion type printing plate 5 is inserted into the plate insertion groove 40 to attach the insertion type printing plate 5 onto the outer peripheral surface of the sleeve cylinder 30.

The plate insertion groove 40 needs to be of an adequate depth sufficient to accept the grip leading end 5*a* and the grip trailing end 5*b* of the insertion type printing plate 5. As mentioned above, however, the sleeve cylinder 30 (cylinder body 31) is made thin because of its weight reduction. The inner peripheral surface of the sleeve cylinder 30 (cylinder body 31) is then formed with an axially continuous convex area 41 for grooving, which area is formed with the plate insertion groove 40 that is of a sufficient depth even though the sleeve cylinder 30 is made thin in wall thickness. In other words, the depth of the plate insertion groove 40 can be made larger than the wall thickness of the sleeve cylinder 30 (cylinder body 31).

A deterioration of balancing in rotation of the sleeve cylinder 30 by forming the convex area 41 for grooving on a portion of its inner cylindrical surface is avoided by forming a dynamically balancing convex area 42 as shown at a position diametrically symmetrical to the convex area 41 for grooving on the inner cylindrical surface of the sleeve cylinder 30. Thus, the sleeve cylinder 30 being dynamically balanced in rotation can be stably rotated.

This allows the plate cylinder 2 to be rotated rapidly, permitting high-speed printing.

Mention is next made of an operation of mounting and dismounting the sleeve cylinder onto and from the rotating shaft 20 for the plate cylinder 2.

The plate cylinder housing member 15 is turned to open the opening 11 of the other side main frame member 1*b* to allow entry of a sleeve cylinder.

The sleeve cylinder pushing member 28 is set in its inactive state by manipulating to rotate the rotor 28*a* to leave the cam 28*b* in the hollow 29*d*.

The shaft fastening mechanism 37 is set in its release state by unfastening the fastening bolt 37*c* to contract the fastening member 37*a*.

The ring 36 and the one side cylinder bearer 34 of the sleeve cylinder 30 are fitted on the other axial end shaft section 24 of the rotating shaft 20 and moved along the axial intermediate shaft section 23 towards the one axial end side by moving the sleeve cylinder 30 towards the one axial end side, namely towards the one side main frame member 1*b*.

The inner peripheral surface 34*a* (the tapered surface 38) of the one side cylinder bearer 34 of the sleeve cylinder 30 is then forcibly fitted on and in close contact with the tapered portion 22*b* (the sleeve cylinder supporting tapered surface 25) while the one axial end face 36*a* of the ring 36 (the one axial end face 30*a* of the sleeve cylinder 30) is brought into contact with the other axial end face 29*a* of the pusher mounting ring 29.

The groove 27*c* of the ring 36 is then fitted on the pin 27*b*, rotationally positioning the sleeve cylinder 30.

As a result, the one axial end side (deep side) of the sleeve cylinder 30 is securely fixed to the one axial end side (deep side) of the rotating shaft 20 in a state of no backlash and no axial deflection of the sleeve cylinder 30.

In the meantime, the fastening member 37*a* in the shaft fastening mechanism 37 is left contracted so that the fastening member 37 and the other axial end shaft section 24 (sleeve cylinder supporting outer peripheral surface 26) of the rotating shaft 20 are opposite to each other leaving the annular gap, allowing the sleeve cylinder 30 to be fitted on and along the rotating shaft 20 readily and smoothly.

In the state that the sleeve cylinder 30 has been fitted on the rotating shaft 20 up to its one axial end side, the fastening bolt 37*c* in the shaft fastening mechanism 37 is fastened to expand the fastening member 37*a*, fastening the other side cylinder bearer 35 of the sleeve cylinder 30 frictionally to the other axial end shaft section 24 of the rotating shaft 20 by the shaft fastening mechanism 37.

Since in this manner the one axial end side of the sleeve cylinder 30 is fixed to the one axial end side of the rotating shaft 20 in the state that causes no backlash and no axial deflection of the sleeve cylinder 30 while the other end side of the sleeve cylinder 30 is frictionally fastened to the other axial end side of the rotating shaft 20, a sleeve cylinder 30 can constantly be held coaxial with the rotating shaft 20, increasing the reproducibility of the state that, and improving the accuracy at which, it is so held, thereby improving the resultant printing accuracy and quality.

And yet, the sleeve cylinder 30 can simply and easily be securely coupled to the rotating shaft 20, it being only required that the inner peripheral surface 34*a* on the one side cylinder bearer 34 be fitted on the tapered portion 22*b* of the rotating shaft 20 and that the fastening bolt 37*c* be fastened at the other axial end side.

In dismounting the sleeve cylinder 30 from the rotating shaft 20, the fastening bolt 37*c* in the shaft fastening mechanism 37 is unfastened to contract the fastening member 37*a*, forming the annular gap between the fastening member 37*a* and the other axial end shaft section 24 of the rotating shaft 20.

And, drawing the sleeve cylinder 30 towards the near side causes the sleeve cylinder 30 to be moved along the rotating shaft 20 towards the other axial end side and to be extracted therefrom.

Then, the inner peripheral surface 34*a* of the one side cylinder bearer 34 of the sleeve cylinder 30 remains in close contact with the tapered surface 22*b* of the one axial end side shaft section 22. Then, to release the close contact between the inner peripheral surface 34*a* and the tapered portion 22*b* in an operation drawing the sleeve cylinder 30 towards the near side, a much larger force needs to be exerted by the drawer. Therefore, not only is the operation cumbersome, but exerting such force drawing the sleeve cylinder 30 towards the near side may fail to release the close contact between the tapered portion 22*b* and the inner peripheral surface 34*a*.

In this case, the rotor 28*a* of the sleeve cylinder pushing member 28 is turned by the hexagonal wrench to protrude the cam surface 28*b*-1 of the cam 28*b* out of the hollow 29*d* and in turn to press the cam surface 28*b*-1 against the one axial end face 36*a* of the ring 36, namely against one axial end face 30*a* of the sleeve cylinder 30, thereby pushing the sleeve cylinder 30 to move towards its other axial end side, namely towards the near side.

The close contact is thereby released simply and easily between the inner peripheral surface 34*a* (tapered surface 38) of the one side cylinder bearer 34 of the sleeve cylinder 30 and the tapered portion 22*b* (sleeve cylinder supporting tapered surface 25) on the one axial end side shaft section 22 of the rotating shaft 20, permitting the sleeve cylinder 30 to be drawn towards the near side and removed.

Mention is next made of the blanket cylinder 3.

The rotating shaft 20 for the blanket cylinder 3 as shown in FIG. 3 comprises one axial end shaft section 21, one axial end side shaft section 22, an axial intermediate shaft section 23 and the other axial end shaft section 24. The one axial end side shaft section 22 has a large diameter portion 22*a* and a tapered portion 22*b*.

A pusher mounting ring 29 is fitted on and secured to the large diameter portion 22*a* of the one axial end side shaft section 22. The pusher mounting ring 29 has a sleeve cylinder pushing member 28 mounted thereon.

A pin 27*b* as the positioning member 27 is mounted to the large diameter portion 22*a* of the one axial end side shaft section 22.

That is, the rotating shaft 20 for the blanket cylinder 3 is identical to the rotating shaft 20 for the plate cylinder 2.

The sleeve cylinder 30 for the blanket cylinder 3 as with the sleeve cylinder 30 for the plate cylinder 2 is formed of a cylinder body 33 of an aluminum alloy comprising a cylinder body 31 and a plurality of annular disk shaped ribs 32, one side cylinder bearer 34, and the other side cylinder bearer 35. The one side cylinder bearer 34 has an inner peripheral surface 34*a* tapered as a tapered surface 38 and the other side cylinder bearer 35 has an inner peripheral surface formed to form a shaft mounting bore 39.

The other side cylinder bearer 35 is provided with a shaft fastening mechanism 37.

Thus, the sleeve cylinder 30 for the blanket cylinder 3 as with the sleeve cylinder 30 for the plate cylinder 2 can be securely coupled to the rotating shaft 20 and can, moreover, be easily brought to be fitted on, and be extracted, from the rotating shaft 20 in manual operation, hence facilitating its exchanging operation.

Figure 9:
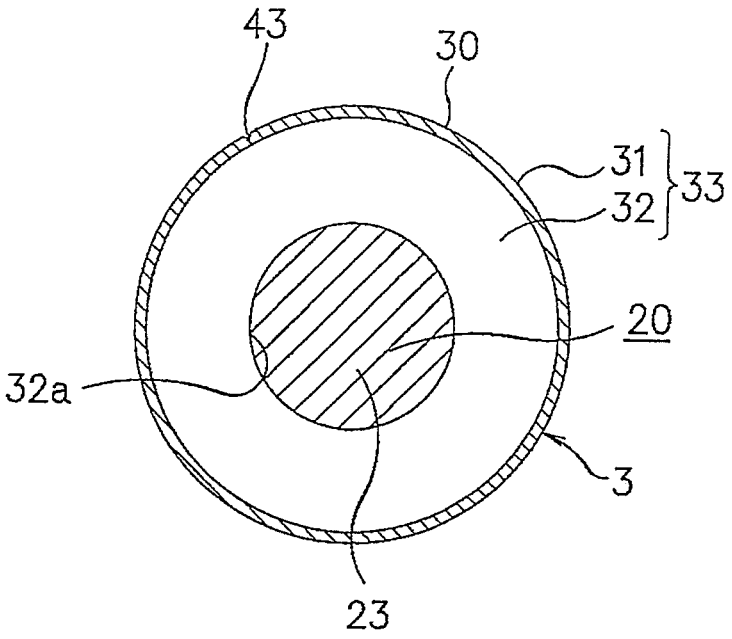
FIG. 9 is a cross sectional view of a portion taken along the line IX-IX in FIG. 3.

The outer peripheral surface of the sleeve cylinder 30 (cylinder body 33) for the blanket cylinder 3 as shown in FIG. 9 is formed with a blanket cutting V-groove 43 which continuously extends axially.

Figure 10A:
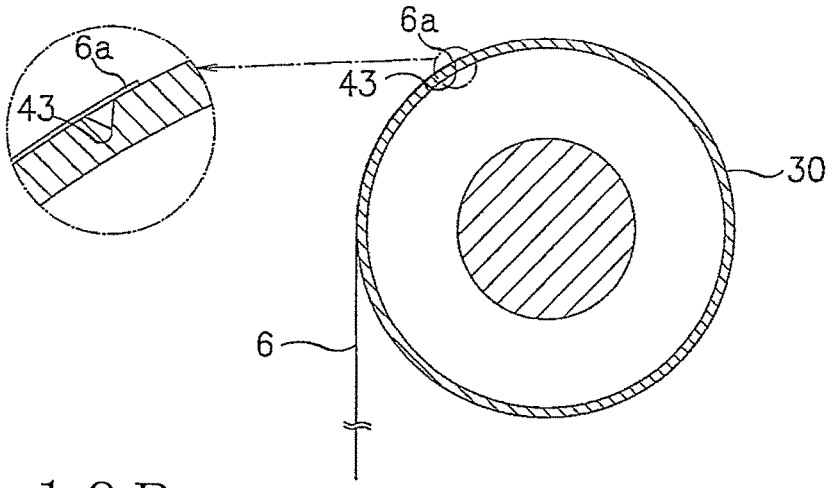
FIGS. 10A, 10B and 10C are views for illustrating an operation of mounting a blanket having a pressure sensitive adhesive.
Figure 10B:
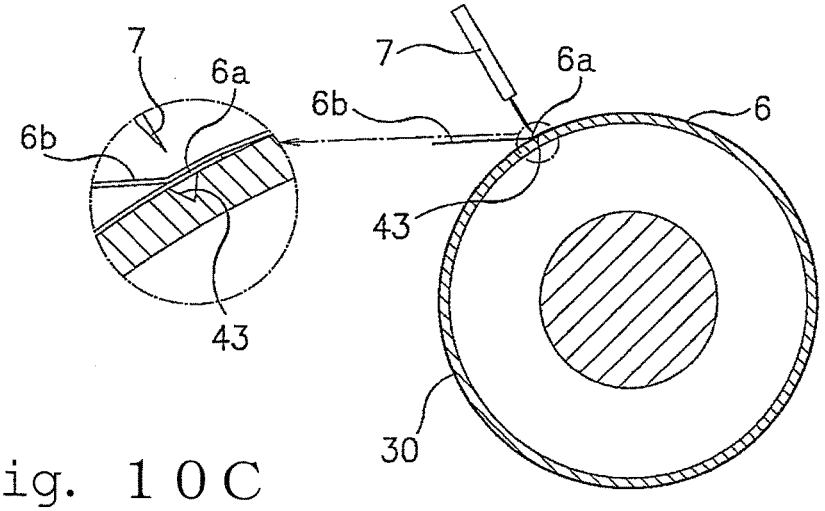

And, a leading edge 6*a* of a blanket 6 with pressure sensitive adhesive as shown in FIG. 10A is stuck on the sleeve cylinder 30 along the blanket cutting V-groove 43. And, using the V-groove 43 as a benchmark, the blanket 6 with pressure sensitive adhesive is wound around and stuck to the outer peripheral surface of the sleeve cylinder 30. As shown in FIG. 10B, a trailing edge 6*b* of the blanket 6 wound around and stuck to the sleeve cylinder 30 passes over and beyond the blanket cutting V-groove 43 and is stuck to the leading edge 6*a*.

Figure 10C:
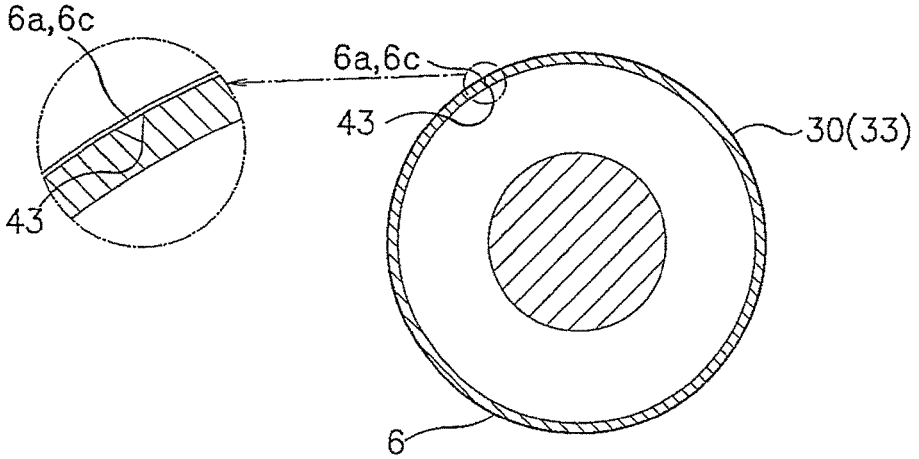

In this state, a cutter blade 7 is moved axially of the sleeve cylinder 30 along the blanket cutting V-groove 43 to cut along the V-groove 43 the blanket 6 with pressure sensitive adhesive, giving rise, as shown in FIG. 10C, to the state that the blanket 6 with pressure sensitive adhesive has been stuck up on the outer peripheral surface of the sleeve cylinder 30.

This makes it possible for a blanket 6 with pressure sensitive adhesive to be stuck to the outer peripheral surface of the sleeve cylinder 30 so that its leading edge 6*a* and any cut edge 6*c* may not overlap.

Moreover, since the cutter blade 7 can only be moved along the blanket cutting V-groove 43, its operation is quite simple.

What is claimed is:

1. A printing cylinder assembly for a printing machine, comprising:

a rotating shaft pivotally supported at one axial end side thereof in a cantilever structure, wherein said rotating shaft is formed at the one axial end side thereof with a sleeve cylinder supporting tapered surface, a sleeve cylinder removably mounted on said rotating shaft so that the sleeve cylinder can be axially fitted on and extracted from the rotating shaft from the other axial end side of the rotating shaft, and a sleeve cylinder pushing member which is mounted on said rotating shaft at a side that is closer to said one axial end side of the rotating shaft than said sleeve cylinder supporting tapered surface and which is adapted to push said sleeve cylinder axially towards said other axial end side of the rotating shaft, wherein said sleeve cylinder is formed at one axial end side of an inner diameter portion thereof with a tapered surface, wherein the tapered surface of said sleeve cylinder is adapted to be fitted on and in close contact with the sleeve cylinder supporting tapered surface of said rotating shaft, thereby detachably coupling the one axial end side of the sleeve cylinder with the one axial end side of the rotating shaft, and wherein said sleeve cylinder pushing member comprises a rotor mounted on said rotating shaft so as to be rotatable about an axis orthogonal to said rotating shaft and a cam formed on the rotor, said cam having an arc-like cam surface off-centered from a center of the rotor whereby rotation of said rotor in a direction forces said cam surface to push one axial end face of said sleeve cylinder.

2. The printing cylinder assembly for the printing machine as set forth in claim 1, wherein:

said rotating shaft is formed at the other axial end side thereof with a sleeve cylinder supporting outer peripheral surface, said sleeve cylinder is formed at the other axial end side of the inner diameter portion thereof with a shaft mounting bore, said sleeve cylinder supporting outer peripheral surface of the rotating shaft and said shaft mounting bore of the sleeve cylinder are spaced apart from each other, defining an annular space between them, and said sleeve cylinder comprises a shaft fastening mechanism mounted thereon for frictionally fastening said sleeve cylinder supporting outer peripheral surface of the rotating shaft and said shaft mounting bore of the sleeve cylinder.

3. The printing cylinder assembly for the printing machine as set forth in claim 2, wherein said shaft fastening mechanism comprises:

a deformable fastening member interposed in said annular space between said sleeve cylinder supporting outer peripheral surface of the rotating shaft and said shaft mounting bore of the sleeve cylinder, and a fastening bolt for expanding and contracting said fastening member whereby fastening and unfastening said fastening bolt expands and contracts said fastening member, respectively.

4. The printing cylinder assembly for the printing machine as set forth in claim 1, further comprising:

a positioning unit mounted across said one axial end side of said sleeve cylinder, and a site on said rotating shaft that is closer to said one axial end side thereof than said sleeve cylinder supporting tapered surface, for rotationally positioning said sleeve cylinder.

5. The printing cylinder assembly for the printing machine as set forth in claim 4, wherein said positioning unit comprises:

a pin mounted at the site on said rotating shaft that is closer to said one axial end side thereof than said sleeve cylinder supporting tapered surface, and a groove formed in said one axial end face of the sleeve cylinder so as to be open to said pin, wherein said groove is fitted on said pin, thereby determining a rotational position of the sleeve cylinder.

6. The printing cylinder assembly for the printing machine as set forth in claim 1, wherein:

said rotating shaft is pivotally supported at said one axial end side thereof in the cantilever structure so that the rotating shaft may not develop an axial deflection or thrust load, and said sleeve cylinder has a hollow structure, is formed axially with a plurality of annular disk shaped ribs on an inner periphery side and made by casting of an aluminum alloy, said plural ribs forming the inner diameter portion for fitting on said rotating shaft, whereby said sleeve cylinder can be brought to be fitted on, and be extracted from said rotating shaft from said other axial end side of the rotating shaft.

7. The printing cylinder assembly for the printing machine as set forth in claim 1, wherein:

said sleeve cylinder comprises a cylinder body which is an aluminum alloy, and which is formed axially with a plurality of annular disk shaped ribs on an inner peripheral surface of said cylinder body, said plural ribs forming the inner diameter portion for fitting on said rotating shaft, and said cylinder body has on the inner peripheral surface thereof a first convex area and a dynamically balancing second convex area positioned diametrically symmetrical to said first convex area, said cylinder body being machined at a region of said first convex area to form a groove therein for insertion of a grip leading end and a grip trailing end of an insertion type printing plate, said sleeve cylinder thereby constituting a plate cylinder.

* * * * *